US010335700B2

(12) United States Patent
Wong

(10) Patent No.: US 10,335,700 B2
(45) Date of Patent: Jul. 2, 2019

(54) TUBE RACER TRACK SYSTEM

(71) Applicant: DONGGUAN SILVERLIT TOYS CO., LTD., Dongguan (CN)

(72) Inventor: Kwok Leung Wong, Causeway Bay (HK)

(73) Assignee: DONGGUAN SILVERLIT TOYS CO., LTD, Dongguan (CN)

( * ) Notice: Subject to any disclaimer, the term of this patent is extended or adjusted under 35 U.S.C. 154(b) by 0 days.

(21) Appl. No.: 15/723,580

(22) Filed: Oct. 3, 2017

(65) Prior Publication Data

US 2019/0099683 A1 Apr. 4, 2019

(51) Int. Cl.

| | |
|---|---|
| ***A63H 18/02*** | (2006.01) |
| ***A63H 30/04*** | (2006.01) |
| ***A63H 18/04*** | (2006.01) |
| ***A63H 17/26*** | (2006.01) |
| ***A63H 17/14*** | (2006.01) |
| ***A63H 18/08*** | (2006.01) |
| ***A63H 29/22*** | (2006.01) |
| ***A63H 17/28*** | (2006.01) |

(52) U.S. Cl.

CPC ..... *A63H 18/028* (2013.01); *A63H 17/14* (2013.01); *A63H 17/262* (2013.01); *A63H 17/28* (2013.01); *A63H 18/02* (2013.01); *A63H 18/021* (2013.01); *A63H 18/04* (2013.01); *A63H 18/08* (2013.01); *A63H 29/22* (2013.01); *A63H 30/04* (2013.01)

(58) Field of Classification Search

CPC ..... A63H 18/00; A63H 18/02; A63H 18/028; A63H 18/04; A63H 18/06; A63H 19/00; A63H 21/00; A63H 30/00; A63F 7/3622

See application file for complete search history.

(56) References Cited

U.S. PATENT DOCUMENTS 2,690,626 A * 10/1954 Gay ..... A63H 18/10 104/242
3,343,793 A 9/1967 Waser
3,509,662 A * 5/1970 Lunzer ..... A63H 18/023 446/216
3,590,522 A 7/1971 Hamano (Continued)

FOREIGN PATENT DOCUMENTS

DE 1813995 12/1969
EP 0389152 A1 9/1990

(Continued)

OTHER PUBLICATIONS

International Search Report to International Application No. PCT/US2017/028565 dated Sep. 7, 2017.

(Continued)

*Primary Examiner* — Eugene L Kim
*Assistant Examiner* — Alyssa M Hylinski
(74) *Attorney, Agent, or Firm* — Greenberg Traurig, LLP

(57) ABSTRACT

A plurality of toy vehicles can race together in a track set. The track system comprises of different types of plastic tubes, toy vehicles and transmitter. The toy tube can be in different shapes such as straight type, curved type, X-type, Y-type and open-type. The tubes can be assembled by end users with simply snapping two symmetrical half tubes together. The vehicle has a drive wheel resiliently urged towards an inner surface of the tube for moving frictionally along the inner surface.

21 Claims, 6 Drawing Sheets

(56) References Cited

U.S. PATENT DOCUMENTS

| | | | | | |
|---|---|---|---|---|---|
| 3,667,153 | A * | 6/1972 | Christiansen | A63H 33/062 | 446/124 |
| 4,231,294 | A | 11/1980 | Arzoumanian | | |
| 4,838,170 | A | 6/1989 | Illakowicz | | |
| 5,357,905 | A | 10/1994 | Gordon | | |
| 5,507,679 | A | 4/1996 | Getsay | | |
| 5,709,583 | A * | 1/1998 | Suto | A63H 17/22 | 446/440 |
| 5,816,980 | A | 10/1998 | Myszka et al. | | |
| 5,820,439 | A * | 10/1998 | Hair, III | A63H 17/16 | 446/233 |
| 5,971,404 | A | 10/1999 | Stoves | | |
| D435,069 | S * | 12/2000 | Berardelli | 446/70 | |
| 6,273,778 | B1 * | 8/2001 | Kyster | A63H 33/042 | 446/168 |
| 6,722,887 | B2 * | 4/2004 | Polonio | G09B 23/12 | 273/129 AP |
| 7,025,656 | B2 * | 4/2006 | Bailey | A63H 17/14 | 104/138.1 |
| 8,011,994 | B2 | 9/2011 | Fink et al. | | |
| 9,027,740 | B2 | 5/2015 | Boehrer | | |
| 9,731,212 | B2 * | 8/2017 | Cheung | A63H 18/02 | |
| 9,732,212 | B2 | 8/2017 | Cheung | | |
| 2005/0266768 | A1 * | 12/2005 | Bailey | A63H 17/14 | 446/427 |
| 2009/0068324 | A1 * | 3/2009 | Sandoval | A23G 9/503 | 426/134 |
| 2009/0095229 | A1 | 4/2009 | Plante | | |
| 2010/0107990 | A1 | 5/2010 | Plante | | |
| 2010/0304640 | A1 | 12/2010 | Sofman et al. | | |
| 2012/0272921 | A1 * | 11/2012 | Santarsiero | A01K 15/025 | 119/707 |
| 2015/0093961 | A1 * | 4/2015 | vom Scheidt, Jr. | A63H 17/00 | 446/454 |
| 2015/0122903 | A1 * | 5/2015 | Boyce | A63H 18/028 | 238/10 A |
| 2016/0220915 | A1 * | 8/2016 | Cheung | A63H 18/02 | |
| 2018/0043273 | A1 * | 2/2018 | Farrell | A63H 17/004 | |
| 2018/0085679 | A1 * | 3/2018 | Welch | A63H 29/14 | |

FOREIGN PATENT DOCUMENTS

| | | | | |
|---|---|---|---|---|
| EP | 1015084 | B1 | 12/2004 | |
| GB | 2096474 | A * | 10/1982 | A63H 18/02 |
| GB | 2096474 | A * | 10/1982 | A63H 18/02 |
| GB | 2301162 | A | 11/1996 | |
| GB | 2440247 | A | 1/2008 | |
| HK | 1209265 | | 3/2017 | |
| WO | 2016026039 | A1 | 2/2016 | |
| WO | 2017184836 | A1 | 10/2017 | |

OTHER PUBLICATIONS http://neat-oh.com/images/zipes/a2280xx/performance-pack/.

Neat-oh Catalogue; www.neat.oh.com; Neat-Oh! "Making Playtime Even More Special!" (23 pages).

Zipes Instruction Manual; Performance Pack; Zipes Speed Pipes; 4 pages; (2016).

Astra 2017 Best Toys for Kids Award; 4 pages (2017).

Neat-Oh!; Next 'Big Thing' in Vehicle Play Replaces Tracks for Pipes that Defy Gravity, Even in the Dark!; Zipes Toy Fair 2017; 2 pages (2017).

Zipes Speed Pipes; Gravity Defying Selfie Stop Demo; 1 page (2017).

Third Party Observations, dated Jul. 20, 2018, from International Patent Application No. PCT/US2017/028565.

European Search Report, dated Jan. 22, 2019, from related European patent App. No. 18196000.

* cited by examiner

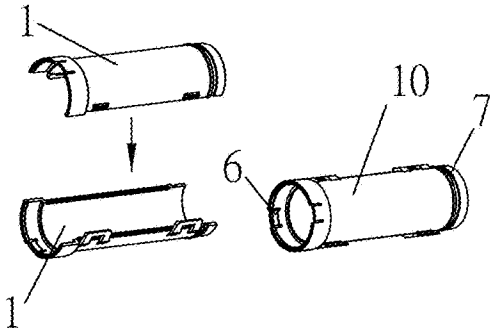
FIG.1a
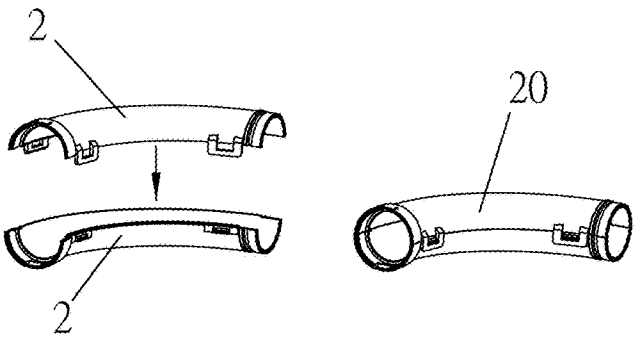
FIG.1b
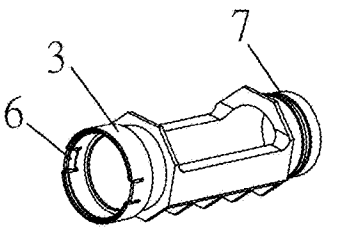
FIG.1c
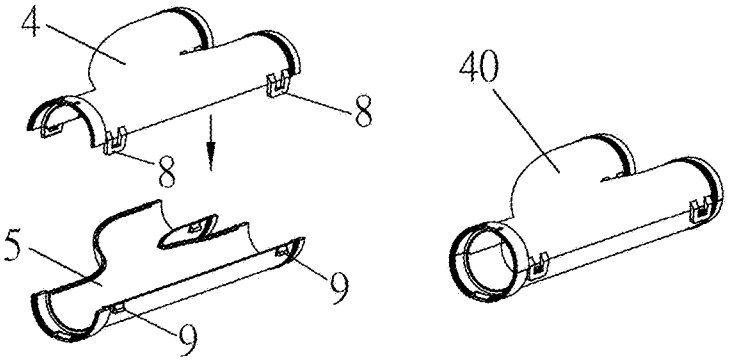
FIG.1d
FIG.1

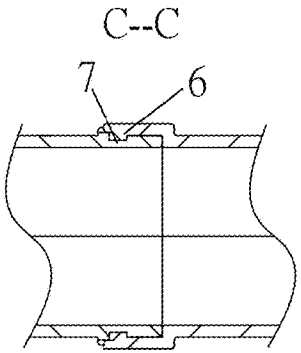
FIG.2d
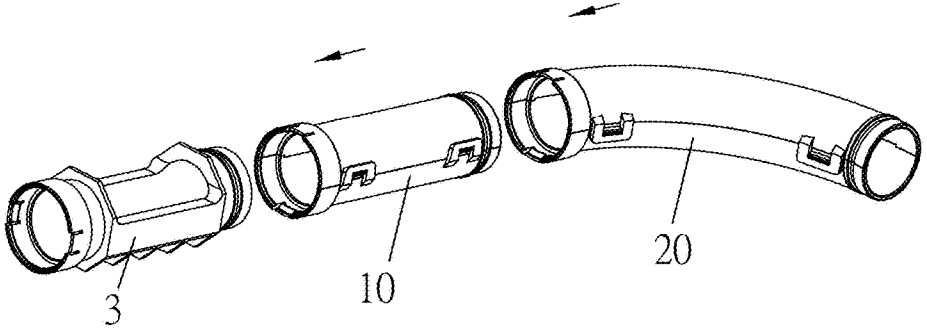
FIG.2a
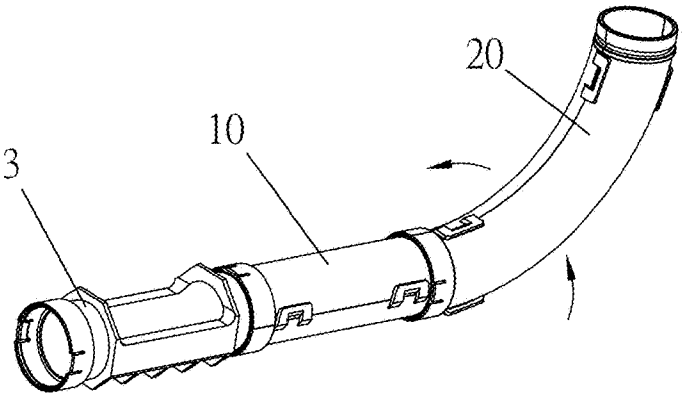
FIG.2b
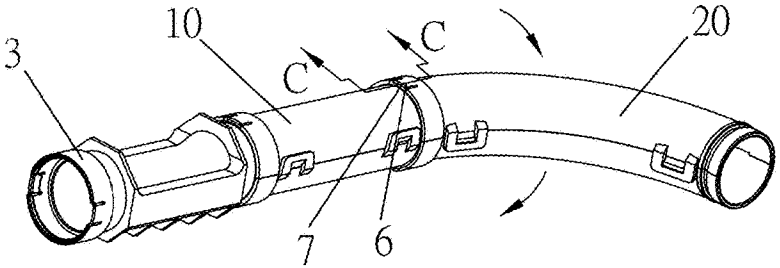
FIG.2c
FIG.2

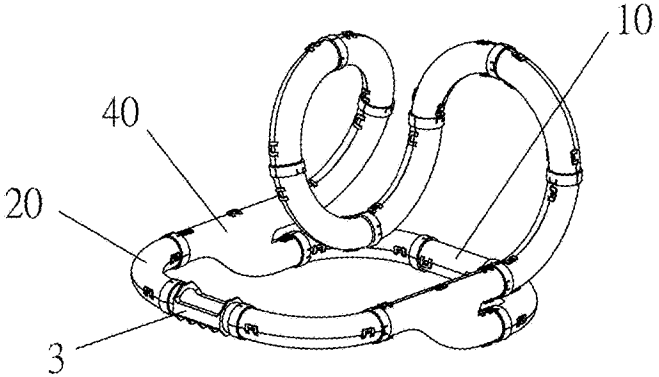
FIG.3a
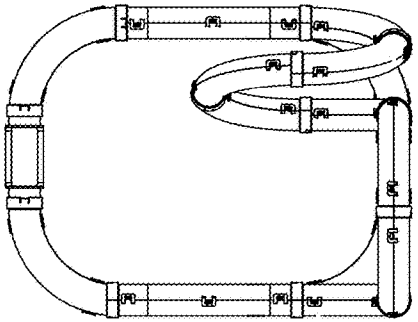
FIG.3b
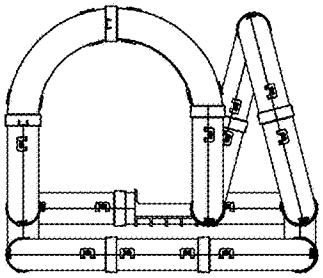
FIG.3c
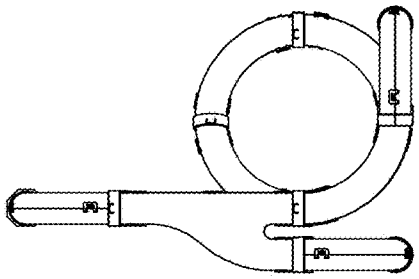
FIG.3d
FIG.3e
FIG.3

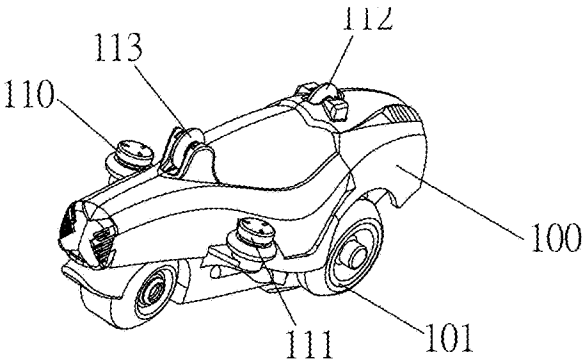
FIG.4a
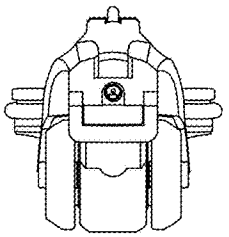
FIG.4d
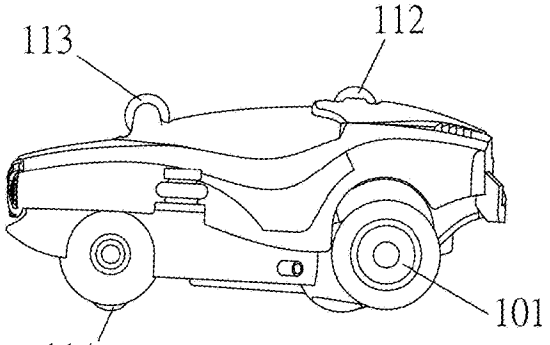
FIG.4c
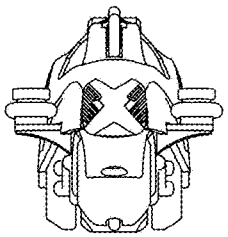
FIG.4b
FIG.4

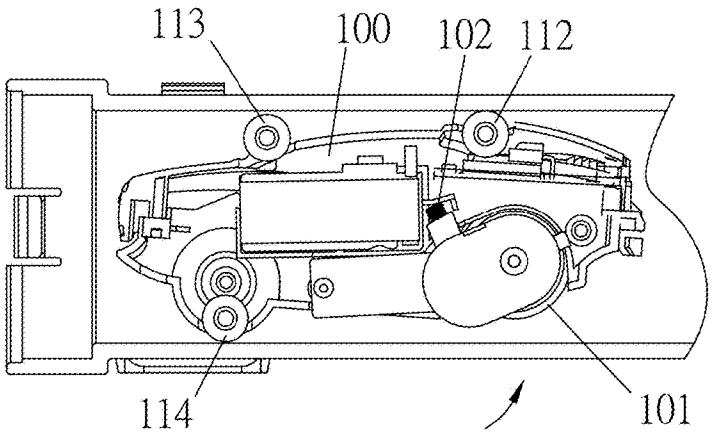
FIG.5a
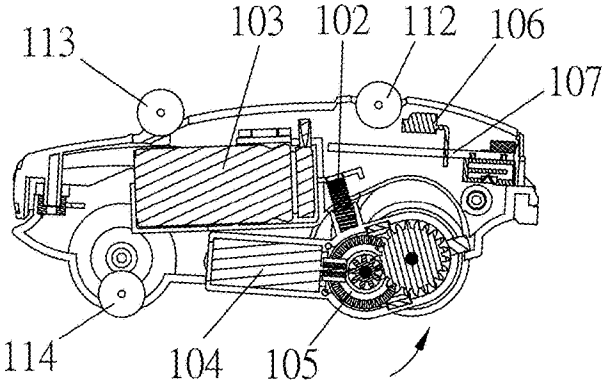
FIG.5b
FIG.5c
FIG.5

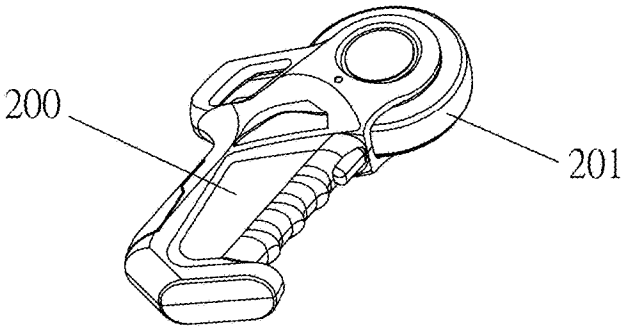
FIG.6a
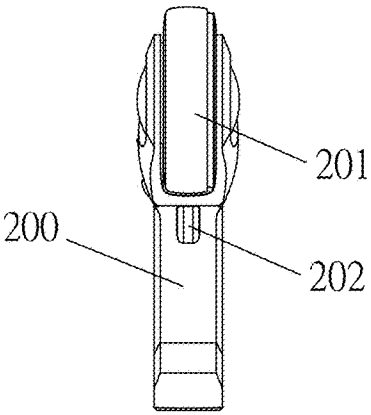
FIG.6c
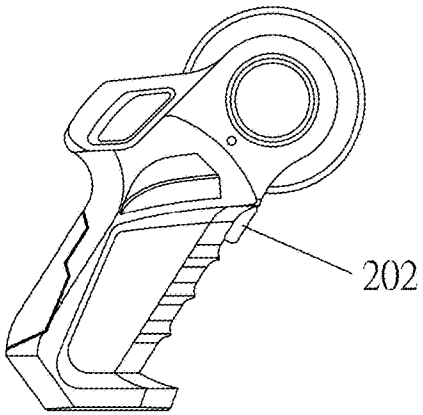
FIG.6b
FIG.6

TUBE RACER TRACK SYSTEM

BACKGROUND

The present disclosure relates to a toy vehicle and a toy track system.

Many toy track systems are open top track systems where toy vehicles, especially those travelling at relatively high speed can easily fall out or shoot off.

It is known to provide a closed track system. U.S. Pat. No. 9,731,212 (Cheung). That system is not flexible in use and is restrictive of vehicle traffic patterns and speeds.

The disclosure overcomes the problems of existing toy vehicle and toy track systems.

SUMMARY OF THE DISCLOSURE

There is provided a toy vehicle and track system within which one or more toy vehicles move along. The disclosure relates to a toy tube track set.

A plurality of toy vehicles can race together in this track set. The track system comprises of different types of plastic tubes, toy vehicles and a transmitter. The toy tube can be in different shapes such as straight type, curved type, X-type, Y-type and open-type. In the disclosure, most of the tubes can be assembled by end users by simply snapping two symmetrical half tubes together.

The tubes are inter-engageable with each other to be freely rotatable relative to each other, the rotatability being about a central axis running through each tube end.

A vehicle runs through the tubes without being pressed against the inner sidewall of the tubes. The vehicle has a drive wheel resiliently urged towards an inner surface of the tube for moving frictionally along the inner surface.

A toy kit comprising the toy vehicle and the toy track system.

DRAWINGS

The disclosure is described, by way of example only, with reference to the accompanying drawings, in which:

FIG. 1*a* is a perspective view of a first half tube and a second half tube of a straight type tube and the tube formation.

FIG. 1*b* is a perspective view of a first half tube and a second half tube of a curved type tube and the tube formation.

FIG. 1*c* is a perspective view of an open-type tube.

FIG. 1*d* is a perspective view of a first half tube and a second half tube of Y-type tube and the tube formation.

FIG. 2*a* is a perspective view of a part of the track set by connecting open-type, straight type and curved type tube together in one angular position.

FIG. 2*b* is a perspective view of part of the track set by connecting open-type, straight type and curved type tube together in second angular position.

FIG. 2*c* is a perspective view of part of the track set by connecting open-type, straight type and curved type tube together in a third angular position.

FIG. 2*d* is a cross-sectional view at point C in FIG. 2*c*.

FIG. 3*a* to FIG. 3*e* are different views of a closed loop track set.

FIG. 4*a* is a perspective view of a vehicle.

FIG. 4*b* is a front view of the vehicle.

FIG. 4*c* is a side view of the vehicle.

FIG. 4*d* is a rear view of the vehicle.

FIG. 5*a* is a top view of the vehicle.

FIG. 5*b* is a cross-sectional view of the vehicle.

FIG. 5*c* is a cross-sectional view of the vehicle inside a tube.

FIG. 6*a* is a perspective view of a transmitter.

FIG. 6*b* is a side view of the transmitter.

FIG. 6*c* is a front view of the transmitter.

DESCRIPTION

The disclosure is described in further detail with reference to the drawings.

A toy track system for a toy vehicle to move therein and along, comprising: a plurality of tube sections including at least first and second tube sections which are connectable endwise together to form part of the toy track system.

Each of the tube sections has first and second parts which are connected with adjacent first or second parts of axially adjacent tubes to connect axially between the first and second tube sections. There are interlocking structures which are provided on the first and second tube sections respectively and are connected with each other to fix the first and second tube sections. The tubes are relatively rotatable about each other along a longitudinal axis running through each tube. The first and second tubes are connectable endwise for inter-engagement to connect axially between the first and second tube sections.

The toy track system has tubes with a connector formation in the end area of each tube, the connector formations being for interlocking the adjacent tubes.

Each tube section is formed by two elongated portions, each portion being a semicircular half tube having elongated edges, the semicircular half tubes being releasably connectable on the elongated edges thereby to form a circular tube.

The semicircular tubes have at least one latch on a first longitudinal edge of one half tube and being releasably connectable to a mating hook on the elongated edge of another half tube thereby to form a circular tube.

A toy vehicle for moving in and along a toy track system has a longitudinal central plane including a longitudinal central axis. The vehicle body has opposite first and second ends and opposite first and second sides. There is a driving wheel provides at the first end on the first side of the vehicle body for frictional engagement with an inner surface of track system to move the vehicle body.

A motor is provided in the vehicle body for rotating the driving wheel. Gears are provided in the vehicle body for transmitting drive from the motor to the driving wheel for rotating the driving wheel. The driving wheel is mounted to be urged towards an inner surface of a tube of the track system to maintain frictional engagement of the driving wheel on the surface.

At least two principal guides are provided on the first end of the vehicle body, the principal guides being angular displaced from the driving wheel and being for maintaining the driving wheel substantially in a central plane when the toy vehicle moves along the toy track system;

There can be at least three auxiliary guides provided on the second end of the vehicle body and radially offset from the principal guides for maintaining the driving wheel substantially in a central plane when the toy vehicle moves along the toy track system.

The principal guides are located opposite one another. The principal guides are located on a first plane which extends perpendicular to a second plane on which the driving wheel is located. The at least three auxiliary guides are equally spaced apart from each other and are located radially offset.

The second end of the vehicle body is provided with four auxiliary guides radially offset from the principal guides for maintaining the driving wheel substantially in a central plane when the toy vehicle moves along the toy track system.

The four auxiliary guides are located substantially perpendicular to one another and are radially offset.

The auxiliary guides are radially displaced from the driving wheel such that the auxiliary guides are relatively closer to the vehicle body than the driving wheel.

The principal and auxiliary guides include rotatable elements.

There is a transceiver system between a vehicle and a transmitter whereby the vehicle is controllable by signals from the transmitter.

The first and second tubes are provided at one end of the first and second tube sections respectively at which they are connectable endwise.

The first tube is insertable into the second tube for inter-engagement of the first and second tubes to connect axially between the first and second tube sections.

The coupled first and second tubes inter-engage towards their ends to connect axially between the first and second tubes. They interlock and can be relatively freely rotatable relative to each other.

A toy vehicle moves in and along a toy track system having a longitudinal central axis. The vehicle includes a body having opposite first and second end and opposite first and second sides. There is a driving wheel provided at the first end on the first side of the vehicle body for frictional engagement with an inner surface of track system to move the vehicle body.

A motor in the vehicle body rotates the driving wheel. There are gears in the vehicle body for transmitting a drive from the motor to the driving wheel for rotating the driving wheel.

The vehicle is free to move in the tube. A driven geared wheel in the vehicle is urged by the internal suspension to engage the tube and the driving wheel propels the vehicle in the tube. The driving wheel is mounted to be relative movable towards and away from the vehicle body and be rotatable relative to the vehicle body.

The toy vehicle includes guides are disposed on the top end and a bottom end and first and second sides of the vehicle, and are fixedly mounted to the vehicle body to be fixedly spaced relatively to the body. The principal guides are located on a first plane which extends-removed from and relative to a second plane on which the driving wheel is located. The guides include freely rotatable elements.

At least two principal guides are provided on the first end of the vehicle body, the principal guides being displaced from the driving wheel and maintaining the driving wheel substantially in a central plane when the toy vehicle moves along the toy track system.

There can be at least three auxiliary guides provided on the second end of the vehicle body and radially offset from the principal guides for maintaining the driving wheel substantially in a central plane when the toy vehicle moves along the toy track system.

The principal guides are located opposite one another. The principal guides are located to extend relatively in a removed planar sense to where the driving wheel is located and are aligned with each other.

The auxiliary guides are equally spaced apart from each other and are located to be relatively radially offset.

The second end of the vehicle body can be provided with four auxiliary guides radially offset from the principal guides for maintaining the driving wheel substantially in a central plane when the toy vehicle moves along the toy track system. The four auxiliary guides are located to be relatively radially offset.

The auxiliary guides are radially displaced from the driving wheel such that the auxiliary guides are relatively closer to the vehicle body than the driving wheel.

| Numbering: | |
|---|---|
| No. | Part Name |
| 1 | Half of straight type tube |
| 2 | Half of curved type tube |
| 3 | Open-type tube |
| 4 | First half of y-type tube |
| 5 | Second half of y-type tube |
| 6 | Snap joint |
| 7 | Notched ring segment |
| 8 | Latch |
| 9 | Hook |
| 10 | Straight type tube |
| 20 | Curved type tube |
| 40 | Y-type tube |
| 100 | Vehicle |
| 101 | Rear driving wheel |
| 102 | Suspension system |
| 103 | Battery |
| 104 | Motor |
| 105 | Gear system |
| 106 | IR receiver |
| 107 | PCBA |
| 110 | Right guide rotatable element |
| 111 | Left guide rotatable element |
| 112 | Top guide rotatable element |
| 113 | Top guide rotatable element |
| 114 | Front wheel |
| 200 | Transmitter |
| 201 | Turning wheel |
| 202 | Turbo button |

Tube Design

Generally, the tubes are in a plane of symmetry design so that they can be assembled by snapping the hooks 9 of a first half tube to the latches 8 of a second half tube at one side and snapping the latches 8 of a first half tube to the hooks 9 of a second half tube at the other side. Alternatively, all hooks and latches are put on first half tube and second half tube respectively.

With this tube design, it is possible to stack up all half tubes with same shape for close packing.

The first end of the tube includes a flexible snap joint 6 while the other end of the tube includes a notched ring segment 7.

To connect two tubes together to form part of the track set, the snap joint of first tube is plugged into the notched ring segment of second tube. FIG. 2*d*.

After snapping the first tube to second tube, both tubes can be free to rotate along their longitudinal axis. FIGS. 2*a*, 2*b* and 2*c*.

By cascading many different tubes with this method and rotating the tubes at any desired angular position, an open or closed loop track set can be constructed.

While racing, users should put their vehicles with different ID inside the track set through the inlet of open-type tube. They can drive their vehicles by corresponding transmitters and change their lanes inside X-type or Y-type tube.

Track Set

A set of plastic tube which can be used to construct at least one complete open or closed loop in 2D or 3D pattern.

Vehicle

The vehicle 100 comprises:

Car body dc motor 104 for forward and backward movement. Alternatively, it is possible to have plurality of motors and rotatable elements for moving Forward, Backward, Left and Right Rear driving wheel 101 and the corresponding gear system 105

Front wheel 114

Top guide rotatable elements 112 and 113

Right guide rotatable element 110 and left guide rotatable element 111

Rechargeable battery 103

Charging system for rechargeable battery 103

Suspension system 102, which is internally mounted in the vehicle body

One IR receiver 106

PCBA 107 which includes a MCU to drive motors, to control LEDs and to analyze the signals from IR receiver.

Transmitter

The transmitter 200 comprises:

A Turbo button 202.

One turning wheel 201 for forward, backward and stop control.

At least one IRed for IR transmission.

One MCU on PCBA to generate IR signals.

Forward or backward speed of the vehicle is linearly proportional to the angular position of turning wheel.

Different vehicles and transmitters have their ID.

The IR signal from transmitter embedded at least one of the following information:

Vehicle ID

Speed

Moving direction

Turbo status

Alternatively, the transmitter can have Forward, Backward, Left and Right buttons. In this way, it supports full function control and it is possible to play with the car off the track set.

Alternatively, the whole smart driving system can work properly without a transmitter.

The control method of transmitter is not limited to Infrared. It can be radio controlled, Bluetooth or WiFi controlled.

Upon receipt the IR signal from transmitter, if its ID is match, the vehicle will move or stop according to the signal command.

The vehicle is equipped with at least 4 guide rotatable elements to ensure it can run smoothly inside the tube.

The vehicle is driven inside the tube in an extreme case, for instance, vertically upward or downward without slip. Firstly, there is the rear driving wheel which associates with the suspension system to provide sufficient friction between the rear driving wheel and the tube surface at different angular positions. This occurs even though the tube is not a perfect cylinder or a cylinder. Secondly, when the motor is in a high speed turning mode, the driving wheel provides high torque and hence works to overcome the gravitational force of the vehicle itself.

The vehicle can be equipped with over-current detection design. When a player holds at least one of the driving rotatable elements or wheels and leads to a motor stall, the MCU can measure this unexpected high current and stop the motor power automatically.

The vehicle can be recharged by a USB cable and external charger or through transmitter Alternatively, the car can be driven by plurality or number of button cells, alkaline or heavy-duty batteries.

The disclosure has been set out by way of example only. For instance, one or more of the driving wheel, front wheel and one or more of the rotatable guiding elements can be sized larger or smaller radially and/or laterally relative to the vehicle body. Various other modifications of and/or alterations to the described embodiment may be made without departing from the scope of the disclosure as set out in the following claims.

The invention claimed is:

1. A closed loop toy track and a motorized toy vehicle for moving within the closed loop toy track, comprising:

a plurality of elongated tube sections which are connectable to form an endless closed loop track, each of the tube sections having a first end part and a second end part which are configured to axially connect with a complimentary one of the first or second end parts of adjacent tube sections by means of respective interlocking structures provided on the first and second end parts of each tube section such that the tube sections are rotatable relative each other about a longitudinal axis running through each tube section, the interlocking structures include a flexible snap joint on the first end part for engaging with a notched ring segment on the second end part, wherein one of the flexible snap joint or the notched ring segment extends partially around a circumference of its respective tube while the other of the flexible snap joint or notched ring segment extends completely around the circumference of its respective tube such that the relative rotation of the connected tube sections is possible over the entire circumference of the connected tube sections and the relative rotation permits the track to form a three dimensional layout, wherein each of the tube sections is open adjacent the first and second end parts and throughout the tube sections to form an unobstructed straight axial pathway, the tube sections are each formed by two separate and distinct half tubes with elongated edges configured such that the half tubes are releasably connected along the elongated edges;

wherein at least one of the plurality of elongated tube sections is further configured to include an integral branch tube section attached to the elongated tube section between the first and second end parts and having a third end part adjacent the second end part to form a Y-shaped tube section with a first pathway and a second pathway, the first pathway being the unobstructed straight axial pathway and the second pathway being a non-straight pathway formed by the branch tube section, the branch tube section includes a first curved portion forming a juncture with the first pathway and a second straight portion parallel to the first pathway, wherein the juncture is configured to permit a smooth diversion of the motorized vehicle between the first pathway and the second pathway as the motorized toy vehicle moves along the endless closed loop track and wherein the Y-shaped tube section is configured to form multiple closed loop paths within the endless closed loop track; and wherein the motorized toy vehicle is shaped to be longer in length than in height or width and is configured to be propelled without obstruction through the endless closed loop track formed by the plurality of tube sections with a front of the motorized vehicle leading a rear of the motorized vehicle by both a motor in the motorized vehicle and a frictional engaging interaction between the motorized vehicle and an inner wall of the plurality of tube sections due to a biasing action of a spring in the motorized vehicle that urges the motorized toy vehicle against the inner wall.

2. The closed loop toy track and motorized toy vehicle as claimed in claim 1, wherein the flexible snap joint and ring segment collectively form a circumferential protrusion relative to and with an outside diameter greater than an outside diameter of an outer surface of the tube sections.

3. A closed loop toy track and a motorized toy vehicle for moving within the closed loop toy track, comprising:

a plurality of elongated tube sections which are connectable to form an endless closed loop track, each of the tube sections having a first end part and a second end part which are configured to axially connect with a complimentary one of the first or second end parts of adjacent tube sections by means of respective interlocking structures provided on the first and second end parts of each tube section such that the tube sections are completely rotatable relative each other about a longitudinal axis running through each tube section to permit the track to form a three dimensional layout, wherein each of the tube sections is open adjacent the first and second end parts and throughout the tube sections to form an unobstructed straight axial pathway, the tube sections are each formed by two separate and distinct semicircular half tubes with uniform outer surfaces and elongated edges, wherein one of the semicircular half tubes has only latches on the elongated edges and the other one of the half tubes has only hooks on the elongated edges for releasably connecting the elongated edges of the first and second semicircular half tubes together by mating respective latches and hooks such that they form irregular upstanding features relative to the uniform outer surfaces;

wherein at least one of the plurality of elongated tube sections is further configured to include an integral branch tube section attached to the elongated tube section between the first and second end parts and having a third end part adjacent the second end part to form a Y-shaped tube section with a first pathway and a second pathway, the first pathway being the unobstructed straight axial pathway and the second pathway being a non-straight pathway formed by the branch tube section, the branch tube section includes a first curved portion forming a juncture with the first pathway and a second straight portion parallel to the first pathway, wherein the juncture is configured to permit a smooth diversion of the motorized vehicle between the first pathway and the second pathway as the motorized toy vehicle moves along the endless closed loop track and wherein the Y-shaped tube section is configured to form multiple closed loop paths within the endless closed loop track; and wherein the motorized toy vehicle is configured to be propelled without obstruction through the endless closed loop track formed by the plurality of tube sections by both a motor in the motorized vehicle and a frictional engaging interaction between the motorized vehicle and an inner wall of the plurality of tube sections due to a biasing action of a spring in the motorized vehicle that urges the motorized vehicle against the inner wall.

4. A closed loop toy track and a motorized toy vehicle for moving within the closed loop toy track, comprising:

a plurality of elongated tube sections which are connectable to form an endless closed loop track, each of the tube sections having a first end part and a second end part which are configured to axially connect with a complimentary one of the first or second end parts of adjacent tube sections by means of respective interlocking structures provided on the first and second end parts of each tube section, the interlocking structures include a flexible snap joint on the first end part for engaging with a notched ring segment on the second end part, wherein one of the flexible snap joint or the notched ring segment extends partially around a circumference of its respective tube while the other of the flexible snap joint or notched ring segment extends completely around the circumference of its respective tube such that relative rotation of the connected tube sections is possible over the entire circumference of the connected tube sections and the relative rotation permits the track to form a three dimensional layout, wherein each of the tube sections is open adjacent the first and second end parts and throughout the tube sections to form an unobstructed straight axial pathway, the tube sections are each formed by two separate and distinct semicircular half tubes with uniform outer surfaces and elongated edges, wherein one of the semicircular half tubes has only latches on the elongated edges and the other one of the semicircular half tubes has only hooks on the elongated edges for releasably connecting the elongated edges of the first and second half tubes together by mating respective latches and hooks such that they form irregular upstanding features relative to the uniform outer surfaces;

wherein at least one of the plurality of elongated tube sections is further configured to include an integral branch tube section attached to the elongated tube section between the first and second end parts and having a third end part adjacent the second end part to form a Y-shaped tube section with a first pathway and a second pathway, the first pathway being the unobstructed straight axial pathway and the second pathway being a non-straight pathway formed by the branch tube section, the branch tube section includes a first curved portion forming a juncture with the first pathway and a second straight portion parallel to the first pathway, wherein the juncture is configured to permit a smooth diversion of the motorized vehicle between the first pathway and the second pathway as the motorized toy vehicle moves along the endless closed loop track and wherein the Y-shaped tube section is configured to form multiple closed loop paths within the endless closed loop track; and wherein the motorized toy vehicle is configured to be propelled without obstruction through the endless closed loop track formed by the plurality of tube sections by both a motor in the motorized vehicle and a frictional engaging interaction between the motorized vehicle and an inner wall of the plurality of tube sections due to a biasing action of a spring in the motorized toy vehicle that urges the motorized vehicle against the inner wall.

5. A closed loop toy track and a motorized toy vehicle for moving within the closed loop toy track, comprising:

a plurality of elongated tube sections which are connectable to form an endless closed loop track, each of the tube sections having a first end part and a second end part which are configured to axially connect with a complimentary one of the first or second end parts of adjacent tube sections by means of respective interlocking structures provided on the first and second end parts of each tube section such that the tube sections are rotatable relative each other about a longitudinal axis running through each tube section, the interlocking structures include a flexible snap joint on the first end part for engaging with a notched ring segment on the second end part, wherein one of the flexible snap joint or the notched ring segment extends partially around a circumference of its respective tube while the other of the flexible snap joint or notched ring segment extends completely around the circumference of its respective tube such that the relative rotation of the connected tube sections is possible over the entire circumference of the connected tube sections and the relative rotation permits the track to form a three dimensional layout, wherein each of the tube sections is open adjacent the first and second end parts and throughout the tube sections to form an unobstructed straight axial pathway, the tube sections are each formed by two separate and distinct half tubes with elongated edges configured such that the half tubes are releasably connected along the elongated edges;

wherein at least one of the plurality of elongated tube sections is further configured to include an integral branch tube section attached to the elongated tube section between the first and second end parts and having a third end part adjacent the second end part to form a Y-shaped tube section with a first pathway and a second pathway, the first pathway being the unobstructed straight axial pathway and the second pathway being a non-straight pathway formed by the branch tube section, the branch tube section includes a first curved portion forming a juncture with the first pathway and a second straight portion parallel to the first pathway, wherein the juncture is configured to permit a smooth diversion of the motorized vehicle between the first pathway and the second pathway as the motorized vehicle moves along the endless closed loop track and wherein the Y-shaped tube section is configured to form multiple closed loop paths within the endless closed loop track; and wherein the motorized toy vehicle has a body with a rear end, an opposite front end, a first side and a second opposite side shaped to be longer in length than in height or width to define a longitudinal central axis between the opposing front and rear ends of the body, a driving wheel provided at the rear end of the body, a motor within the body operably connected with gears within the body to rotate the driving wheel, at least two principal guides provided on the body displaced from the driving wheel, a plurality of auxiliary guides provided on the body radially offset from the principal guides and an internally mounted suspension system directed from a central portion of the body toward the rear end of the body at a rearward angle that is between non-parallel to the longitudinal axis of the body and a non-right angle to the longitudinal axis of the body and the motorized vehicle is configured to be propelled without obstruction through the endless closed loop track formed by the plurality of tube sections with the front end of the motorized toy vehicle leading the rear end of the motorized vehicle by both the motor in the motorized vehicle and a frictional engaging interaction between the driving wheel of the motorized vehicle and an inner wall of the plurality of tube sections due to the suspension system that urges the motorized toy vehicle against the inner wall.

6. The closed loop toy track and the motorized toy vehicle as claimed in claim 5, wherein the principal guides are disposed on a top of the motorized toy vehicle and the auxiliary guides are disposed on the first and second sides of the motorized toy vehicle, and the principal guides and auxiliary guides are fixedly mounted to the vehicle body to be fixedly spaced relatively to the body.

7. The closed loop toy track and the motorized toy vehicle as claimed in claim 6, wherein the principal guides are located on a first plane which extends removed from and relative to a second plane on which the driving wheel is located and wherein the principal guides are aligned with each other in an axial direction.

8. The closed loop toy track and the motorized toy vehicle as claimed in claim 5, wherein the suspension system is directed to the gears in the vehicle body.

9. The closed loop toy track and the motorized toy vehicle as claimed in claim 7, wherein the front end of the vehicle body is provided with the auxiliary guides radially offset from the principal guides for guiding the driving wheel when the toy vehicle moves along the closed loop toy track.

10. The closed loop toy track and the motorized toy vehicle as claimed in claim 7, wherein the driving wheel is mounted to be movable towards and away from the vehicle body and be rotatable relative to the vehicle body.

11. The closed loop toy track and the motorized toy vehicle as claimed in claim 9, wherein the principal and auxiliary guides include rotatable elements.

12. The closed loop toy track and the motorized toy vehicle as claimed in claim 9, including a transceiver system between the motorized toy vehicle and a transmitter whereby the motorized toy vehicle is controllable by signals from the transmitter.

13. The closed loop toy track and the motorized toy vehicle as claimed in claim 1, wherein the motorized vehicle further includes a body with a rear end, an opposite front end, a first side and a second opposite side to define a longitudinal central axis between the opposing front and rear ends of the body, a driving wheel provided at the rear end of the body, the motor within the body operably connected with gears within the body to rotate the driving wheel, at least two principal guides provided on the body displaced from the driving wheel and a plurality of auxiliary guides provided on the body radially offset from the principal guides.

14. The closed loop toy track and the motorized toy vehicle as claimed in claim 1 wherein the flexible snap joint is located on a circumferential portion of the first end part and comprises at least two relatively short circumferential elements separated from each other by significantly larger circumferential portions of the first end part such that the adjacent tube sections can be snapped together longitudinally without twisting the tube sections relative to each other to effect connection of the tube sections.

15. The closed loop toy track and the motorized toy vehicle as claimed in claim 13 further including a plurality of the motorized vehicles and a transceiver system between each respective vehicle and a transmitter whereby each vehicle is controllable by signals from the transmitter.

16. The closed loop toy track and the motorized toy vehicle as claimed in claim 1 wherein the tube sections are connectable and separable with a straight snapping action along the axial longitudinal axis of the tube sections.

17. The closed loop toy track and the motorized toy vehicle as claimed in claim 1 wherein the elongated edges are straight edges releasably connected by a snapping action.

18. The closed loop toy track and the motorized toy vehicle as claimed in claim 4 wherein the elongated edges are straight edges releasably connected by a snapping action.

19. The closed loop toy track and the motorized toy vehicle as claimed in claim 5 wherein the elongated edges are straight edges releasably connected by a snapping action.

20. A closed loop toy track and a motorized toy vehicle for moving within the closed loop toy track, comprising:

a plurality of elongated tube sections which are connectable to form an endless closed loop track, each of the tube sections having a first end part and a second end part which are configured to axially connect with a complimentary one of the first or second end parts of adjacent tube sections by means of respective interlocking structures provided on the first and second end parts of each tube section such that the tube sections are rotatable relative each other about a longitudinal axis running through each tube section and the relative rotation permits the track to form a three dimensional layout, wherein each of the tube sections is open adjacent the first and second end parts and throughout the tube sections to form an unobstructed straight axial pathway, the tube sections are each formed by two separate and distinct half tubes with elongated edges configured such that the half tubes are releasably connected along the elongated edges;

wherein at least one of the plurality of elongated tube sections is further configured to include an integral branch tube section attached to the elongated tube section between the first and second end parts and having a third end part adjacent the second end part to form a Y-shaped tube section with a first pathway and a second pathway, the first pathway being the unobstructed straight axial pathway and the second pathway being a non-straight pathway formed by the branch tube section, the branch tube section includes a first curved portion forming a juncture with the first pathway and a second straight portion parallel to the first pathway, wherein the juncture is configured to permit a smooth diversion of the motorized vehicle between the first pathway and the second pathway as the motorized toy vehicle moves along the endless closed loop track and wherein the Y-shaped tube section is configured to form multiple closed loop paths within the endless closed loop track; and wherein the motorized toy vehicle is shaped to be longer in length than in height or width and is configured to be propelled without obstruction through the endless closed loop track formed by the plurality of tube sections with a front of the motorized vehicle leading a rear of the motorized vehicle by both a motor in the motorized vehicle and a frictional engaging interaction between the motorized vehicle and an inner wall of the plurality of tube sections due to a biasing action of a spring in the motorized vehicle that urges the motorized toy vehicle against the inner wall.

21. The closed loop toy track and the motorized toy vehicle as claimed in claim 15 wherein the plurality of motorized toy vehicles are run in the closed loop toy track simultaneously to effect racing between the plurality of motorized toy vehicles in the closed loop toy track.

* * * * *